United States Patent [19]

Stebing

[11] Patent Number: 5,011,148

[45] Date of Patent: Apr. 30, 1991

[54] RANDOMIZING APPARATUS

[76] Inventor: Jerry A. Stebing, 212 Pursley Dr., Fort Wayne, Ind. 46807

[21] Appl. No.: 507,660

[22] Filed: Apr. 10, 1990

[51] Int. Cl.[5] ..... A63F 7/04

[52] U.S. Cl. ..... 273/144 B; 273/144 R

[58] Field of Search ..... 273/142 E, 142 F, 142 G, 273/144 R, 144 A, 144 B, 145, 138 R, 161, 115

[56] References Cited

U.S. PATENT DOCUMENTS

| | | | |
|---|---|---|---|
| 2,037,064 | 4/1936 | Burdick | 273/ |
| 2,103,151 | 12/1937 | Dietrich | 275/144 B |
| 4,368,887 | 1/1983 | Gamble | 273/144 B |
| 4,403,775 | 9/1983 | Chaput | 273/144 B |
| 4,465,278 | 8/1984 | Messina et al. | 273/144 B |
| 4,509,755 | 4/1985 | Cheatham | 273/144 B |
| 4,545,578 | 10/1985 | Stagg, Jr. | 273/144 B |
| 4,796,890 | 1/1989 | Snyder | 273/144 B |
| 4,807,881 | 2/1989 | Jaquez | 273/144 B |
| 4,807,882 | 2/1989 | Cimino | 273/144 B |
| 4,822,048 | 4/1989 | Axup | 273/144 B |

FOREIGN PATENT DOCUMENTS

| | | | |
|---|---|---|---|
| 3614822 | 11/1987 | Fed. Rep. of Germany | 273/144 R |
| 2531344 | 2/1984 | France | 273/144 B |
| 94711 | 8/1959 | Norway | 273/144 B |

*Primary Examiner*—Edward M. Coven
*Assistant Examiner*—Raleigh W. Chiu
*Attorney, Agent, or Firm*—Jeffers, Hoffman & Niewyk

[57] ABSTRACT

The randomizer of the present invention includes a frame and a removable cover which define an interior region. A plurality of indicia discs are disposed within the interior region, and are for indicating a member of a predetermined set of symbols. The frame includes receptacles for selecting one of the indicia, with the receptacles in communication with the interior region. Separators are provided for subdividing the interior region into a plurality of compartments. The separators are detachably positioned within the interior region so that a variety of selections are possible.

19 Claims, 3 Drawing Sheets

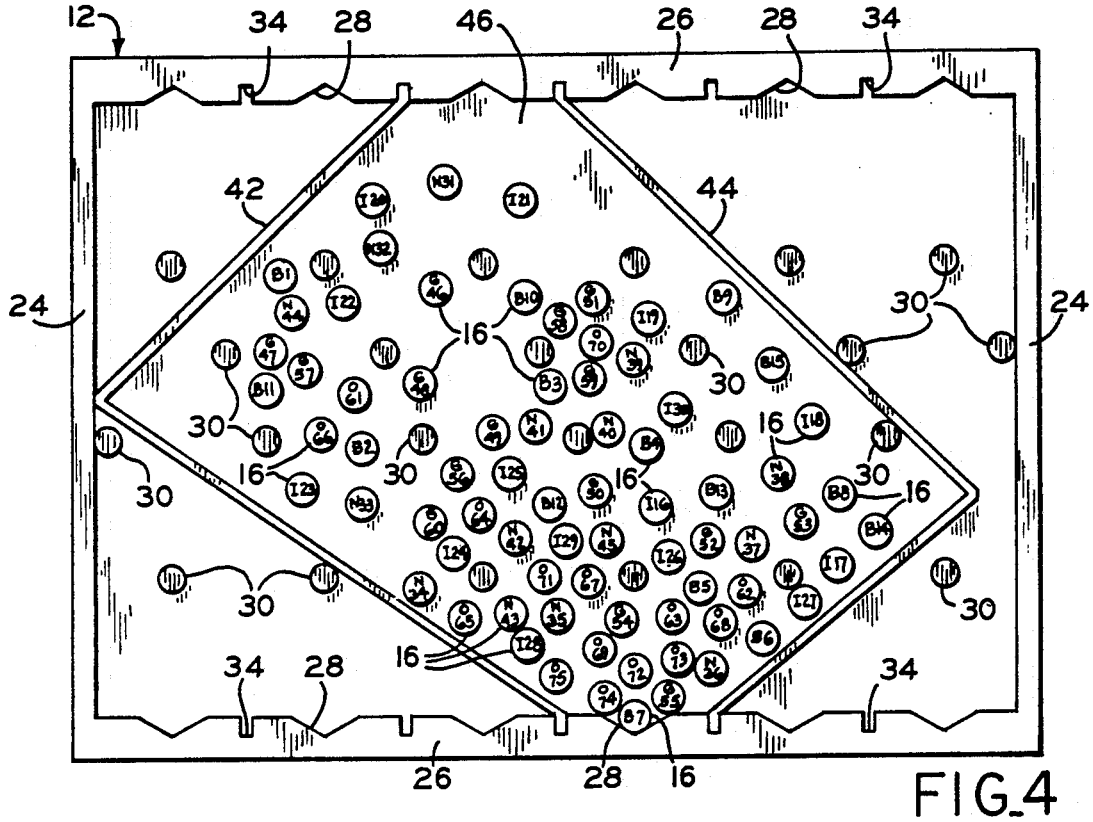
FIG_4
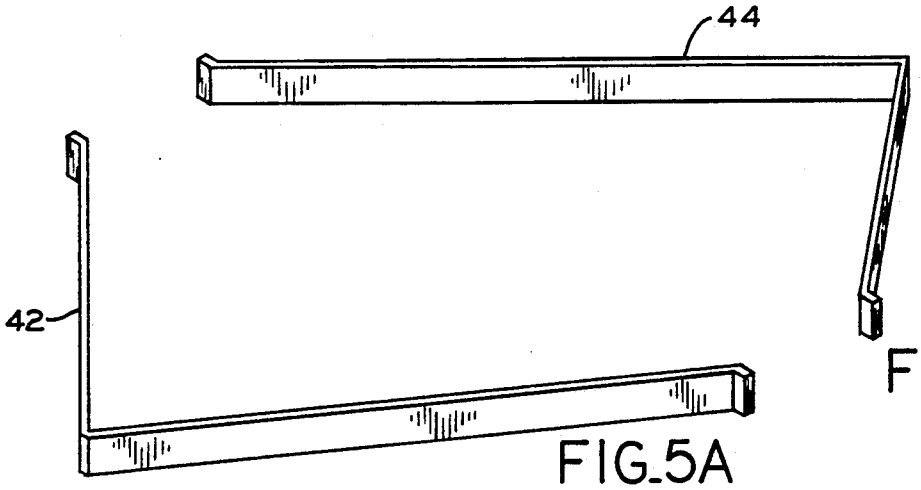
FIG_5B
FIG_5A

RANDOMIZING APPARATUS

BACKGROUND OF THE INVENTION

The present invention relates to games generally and particularly to games which require the random selection of a subset of elements from a larger set of elements. More specifically, the present invention is a randomizing apparatus for selecting tokens from a set, in which each represents an element of the set.

Many games played involve a random selection of values from a larger set of values. For example, dice select one of the numbers between one and six randomly, Bingo machines select numbers randomly between one and seventy-five, and lotteries select six numbers between one and sixty for a Lotto game. Other examples include selecting letters from the alphabet for word games, selecting algebraic symbols to make numeric expressions for a math game, or selecting colors in a child's game. Thus, both adults and children play many games which involve selecting tokens representing element sets.

The details involved in the token selection process should be transparent to the game players. Game players often lack the time or expertise to manipulate the game's random selecting devices. Therefore, a random selection device should be easy to set up and use. Also, a random selection device should require minimal effort to operate, making complicated structures undesirable. An additional problem with complex random selection devices is that their complexity adds to the cost of the devices.

One specific game, a lottery Lotto game, involves selecting several tokens (e.g., 6) having symbols representing numbers from a predetermined set of numbers (e.g., 1–39) without replacement. Several apparatuses are known which use balls and channels to select numbers. Each possible number is associated with a position of one of the channels, and the selected numbers are indicated by having a selecting ball adjacent. However, often players desire a variation in the selection, such as a different number of selections or selections from a different set of elements. However, extensive structural modifications are often necessary to adapt to a variation.

Alternately, a variation requires use of a different apparatus. Also, a frequently used selection is a 2 to 6 digit number for randomly determining game outcomes. For example, many lotteries include games which select a 3 or 4 digit number. To select such a number, one prior art device has chambers with thirty numbered recesses at the bottom which select three digits by having three balls come to rest within the recesses. The three digit number selected corresponds to numerals adjacent to the three recesses occupied by the balls when the device rests. However, modifying this prior art structure to select four digits randomly, without replacement, is difficult. Further, the selection inherently cannot provide an adequately random distribution of outcomes.

Thus, a problem with prior art randomizing devices is that each structure is dedicated to a particular type of game. To be able to play a variety of games, a variety of devices are required. The devices select the appropriate tokens representing the appropriate set of numbers, letters, colors, or other set. What is needed is a randomizing apparatus which is capable of selecting tokens for various games with minimal effort and player expertise. Also, a randomizing apparatus with the aforementioned characteristics is needed which also provides an adequately random distribution of outcomes.

SUMMARY OF THE INVENTION

The present invention is a randomizing apparatus, or randomizer, for use in various games. The structure of the present invention allows for changing between different types of selections quickly and easily. The removable cover allows for placing different sets of indicia within the randomizer, thus varying the possible selections. Also, removable separators positioned in the interior region of the randomizer can change the available mixing space and can determine the number of indicia selected Deflecting pins arranged inside the interior region provide obstacles for the indicia, yet the obstacles do not interfere with the positioning of the separators. Recesses positioned in the receptacle walls of the frame select the indicia.

One type of game having many variations, for which the present invention can readily adapt, is a lottery Lotto game. Some Lotto games are pick-6 games, which select six numbers, while others are pick-5, pick-4, or Pick-3 games. The set of numbers to be selected from also varies, with some games selecting from a range of 1–35, another 1–39, another 1–56, etc. The present invention allows for varying the number of receptacle wall recesses in a compartment. Separators block off one or more recesses which select the indicia. For pick-6, no separators are used, and for pick-5, pick-4, or Pick-3 a separator is used to block off one, two, or three of the slots. The present invention allows for varying the set of numbers by removing the cover and placing only the desired set of numbers in the interior region.

Another type of game easily played with the present invention involves selecting numbers with only 1 or up to 6 digits. The separators divide the mixing chamber into as many sections as needed, with each section having one slot. Then ten indicia labeled 0–9 are placed within each section and the indicia are mixed until one indicia is selected in each section. Thus, each section selects one digit of the selected number.

Learning games can easily be played with the present invention, such as a "jumble" word game or a "math" equation generating game. For the "jumble" game, 26 or more indicia labeled with letters from A to Z are placed within the mixing chamber and up to six of the letters can be selected The six selected letters can then be used to form words. For the math game, the mixing chamber is separated into at least 3 single compartments with the middle compartment having discs with the symbols "+", "−", "×", and "÷". The compartments at the ends have discs labeled 0–9 for selecting digits. Thus, the randomizer generates mathematical equations for the "math" learning game.

With the use of a wide separator which partitions the mixing chamber to create one large compartment having only one slot for selecting indicia, Bingo can be played. The wide separators create a compartment having sufficient space to hold and mix the 75 indicia labeled B1–B15, I16–I30, N31–N45, G46–G60, and 061–075. This wide separator provides a large space for mixing the indicia while the number of indicia selected is limited to a relative few, in this case one selection.

The present invention provides for playing other games as well. Dice can be played by having indicia labeled 1–6 in each compartment, or the indicia may be colored with each indicia having a specific color. The randomizer includes six receptacles on each of the receptacle walls so that most Lotto games can be played. Pick-3, Pick-4, Pick-5, and Pick-6 can alternately be played by varying the numbering of indicia or by dividing the chamber so that one compartment has the requisite number of receptacles. Thus a variety of games are possible with the randomizer of the present invention.

The indicia of the present invention comprises a circular disc having a symbol inscribed upon their face. The circular shape allows for random mixing, while the cylindrical shape keeps the symbols readable from the front of the randomizer. The width of the mixing chamber is slightly greater than the axial width of the discs, allowing for the discs to slide through the mixing chamber easily. In addition, the disc's symbol remains plainly visible.

The present invention, in one form, is a randomizer comprising a frame, a cover, indicia, receptacles, and separators. The frame includes a base and walls. The cover is positioned on the frame, and an interior region between the frame and cover is defined by the cover, base, and walls. Indicia are disposed within the interior region, with the indicia for indicating a member of a predetermined set of elements. The receptacles are for selecting one indicia and are in communication with the interior region. At least one separator is used for subdividing the interior region into a plurality of compartments and are detachably positioned within the interior region.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 4 is a top plan view of a frame of the present invention having V-shaped separators for a bingo game.

FIG. 5A is a perspective view of one of the V-shaped embodiments of separators.

FIG. 5B is a perspective view of the other V-shaped embodiment of separators.

Corresponding reference characters indicate corresponding parts throughout the several views. The exemplifications set out herein illustrate preferred embodiments of the invention, in one form, and such exemplifications are not to be construed as limiting the scope of the invention in any manner.

DESCRIPTION OF THE PREFERRED EMBODIMENT

Figure 1:
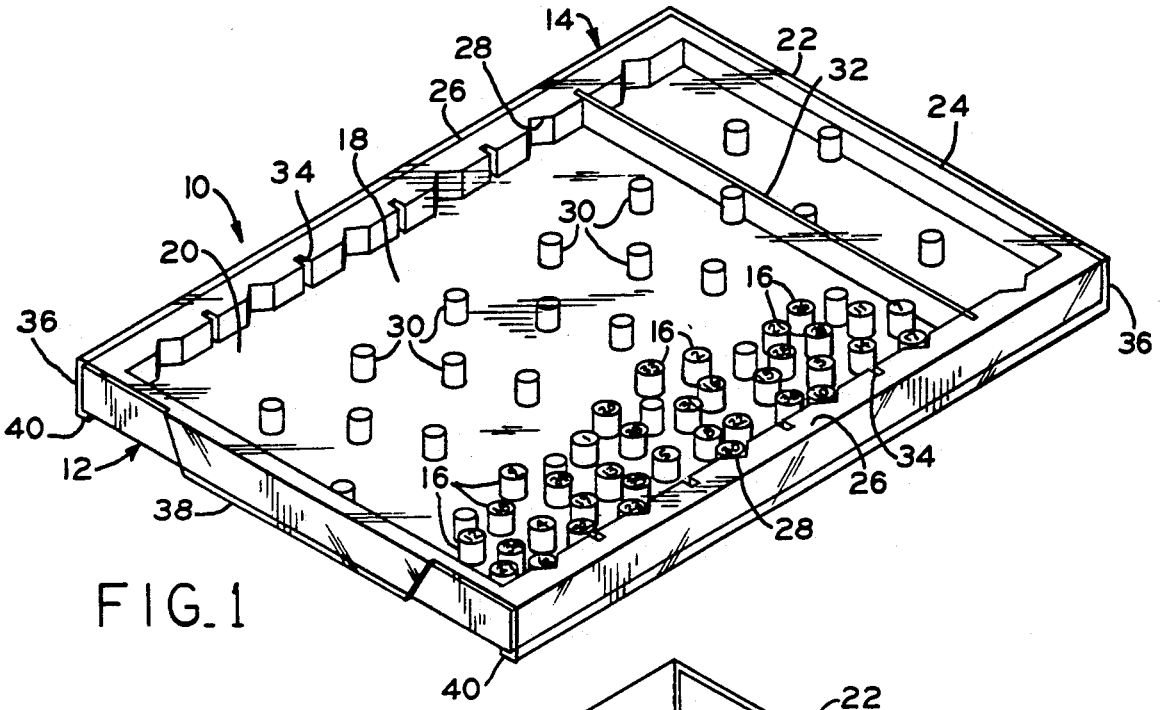
FIG. 1 is a perspective view of the randomizing apparatus of the present invention arranged for a pick-5 game.

The present invention is a randomizer indicated by numeral 10 of FIG. 1. Randomizer 10 includes frame 12 and cover 14 which secure indicia discs 16 within interior region 18. Indicia discs 16 cannot escape from randomizer 10 when closed (FIG. 1) because discs 16 are trapped between base 20 of frame 10 and top surface 22 of cover 14. Preferably, at least one of base 20 and top surface 22 is transparent so indicia discs 16 are visible from the exterior of randomizer 10.

Interior region 18 defines a generally rectangular volume, with base 20 and facing surface 22 providing two planar sides of the rectangular volume. Side walls 24 provide two more of the planar sides, and receptacle walls 26 provide the final two planar sides. Receptacle walls 26 include recesses 28 which have a shape for receiving exactly one indicia disc 16. In the preferred embodiment, six recesses 28 are located on each receptacle wall 26. Secured on base 20 are a plurality of deflection pins 30 for obstructing the travel of discs 16 within interior region 18. Pins 30 have a generally cylindrical shape for deflecting any colliding disc 16. The arrangement of pins 30 serves to block any direct travel by any disc 16 along a line perpendicular to receptacle walls 26.

Figure 3:
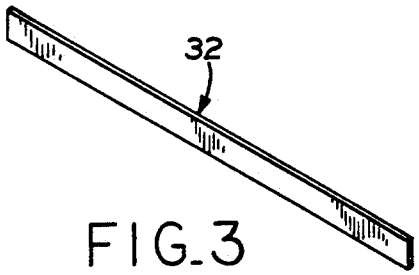
FIG. 3 is a perspective view of one embodiment of the separators of the present invention.

In accordance with the present invention, separators 32 divide interior region 18 into compartments. FIG. 3 shows one embodiment of a separator of the present invention, which is in the shape of an elongated thin rectangular solid. Receptacle walls 26 include support slots 34 which are adapted to engage the ends of separators 32. Each slot 34 is arranged directly across from a corresponding slot 34 (for example, slots 34*a* in FIG. 7) so that a separator 32 engaged in the corresponding slots 34 is perpendicular to receptacle walls 26. In addition, each slot 34 is located intermediate two adjacent recesses 28. Randomizer 10 can be divided into six rectangular compartments (not shown) by using five separators 32 engaged with a corresponding pair of slots 34. If so divided, all six compartments have exactly one recess 28 on each portion of receptacle wall 26 included in the periphery of the compartment.

Pins 30 are arranged on base 20 so that they do not interfere with the placement of any separator 32. However, to promote randomization, some pins 30 are adjacent to the location of an imaginary separator 32 engaged with corresponding slots 26. With this arrangement, some pins (marked 30*a* in FIG. 7) are positioned relatively centrally within each compartment relative to separators 32, while other pins (marked 30*b* in FIG. 7) are positioned near separators 32 in the six compartments. When an actual separator 32 is not present, the pins 30*b* which would have been adjacent to the separator 32 still block linear travel along lines perpendicular to receptacle walls 26.

Figure 2:
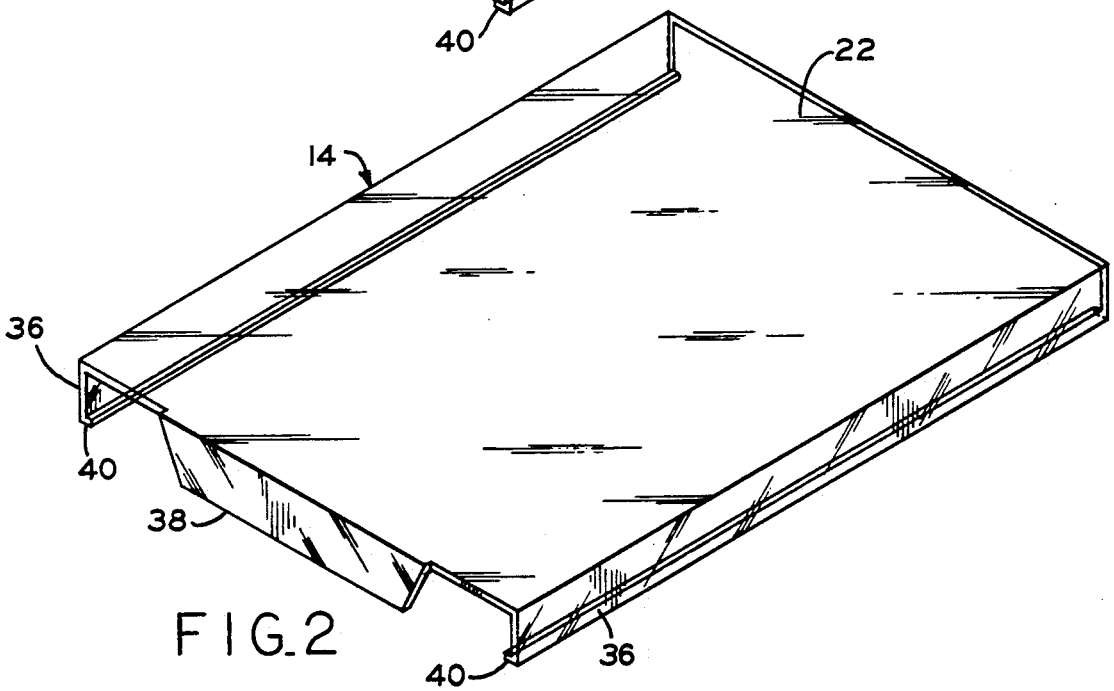
FIG. 2 is a perspective view of the cover of the randomizing apparatus of FIG. 1.

Separators 32 are held inside frame 12 by cover 14. In the preferred embodiment, cover 14 slidably engages frame 12 to provide quick and easy access to interior region 18. However, the cover can be secured to the frame by a metal or plastic screw or other fastener in accordance with the present invention. FIG. 2 shows cover 14 including side flanges 36 and end stop 38. Side flanges 36 extend downwardly from top surface 22 on opposite sides and have a shape which fits around receptacle walls 26 and hooks over base 20 with lips 40 at the end of flanges 36. End stop 38 extends downwardly from top surface 22 so that stop 38 abutting side wall 24 limits the sliding movement of cover 14. By sliding cover 14 off frame 12, separators 32 and indicia discs 16 can be easily accessed.

An alternative embodiment of separators is shown in FIGS. 4, 5A, and 5B. Separators 42 (FIG. 5A) and 44 (FIG. 5B) are generally V-shaped and provide an enlarged compartment 46 (FIG. 4) including half of interior region 18. Also, enlarged compartment 46 includes only one recess 28 on each exposed portion of receptacle walls 26. Utilizing separators 42 and 44, a large number of indicia discs 16, or example 75, can be mixed and one selected in randomizer 10 to play BINGO.

Figure 6:
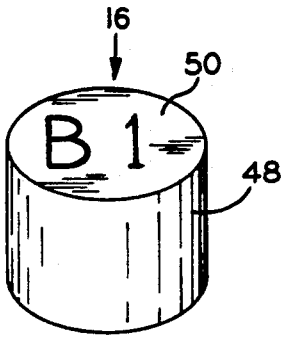
FIG. 6 is a perspective view of a disc of the present invention.

An indicia disc 16 is show in FIG. 6 and preferably has a cylindrical shape. However, discs of other shapes and spherical objects such as marbles can be used with the present invention. Disc 16 includes a cylindrical wall 48 and at least one face 50. Cylindrical wall 48 is for deflecting off pins 30, walls 24 and 26, and other discs 16 when traveling within interior region 18. Inscribed, painted, or otherwise marked on face 50 is a symbol indicative of the set element which each indicia disc 16 represents. The symbol on face 50 is readily apparent by placing disc 16 within interior region 18 and disposing face 50 towards the transparent one of base 20 and top surface 22. If both base 20 and top surface 22 are transparent, disc 16 preferably has two faces 50 with symbols apparent. Discs 16 can be manufactured by sawing off sections from a standard plastic rod having a diameter in the range of 15/32" to 17/31", preferably ½". The width of the sections is in the range of ⅜" to 7/16", preferably 13/32". Also, for selecting colors, colored balls having a diameter of approximately 12 mm are used.

Figure 7:
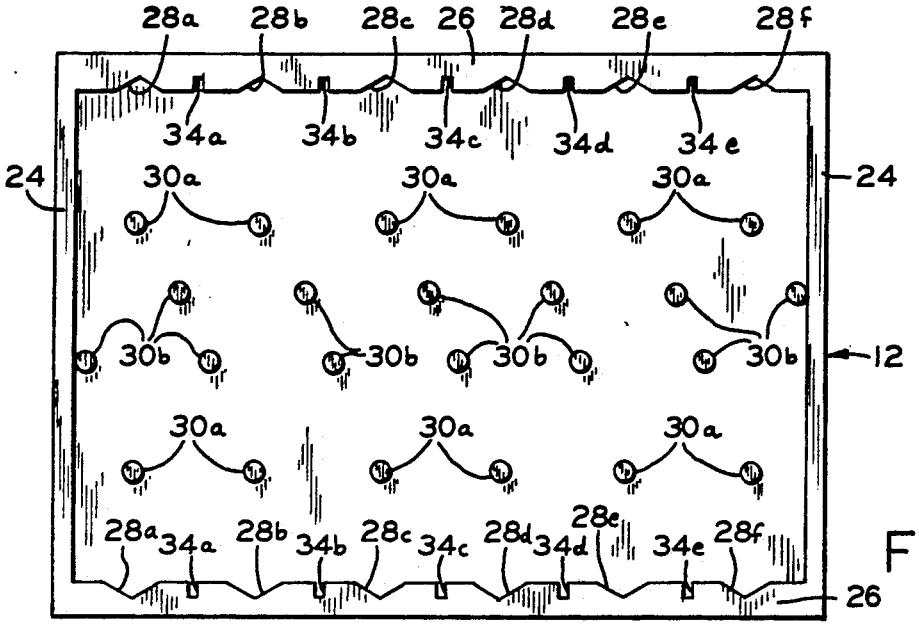
FIG. 7 is a top plan view of the frame of the present invention.

The randomizer of the present invention is capable of selecting a variety of indicia in a variety of combinations for many different games. As described above, FIG. 1 shows a pick-5 Lotto selection of numbers among 1 and 36 without replacement, and FIG. 4 shows a Bingo selection arrangement. FIG. 7, an arrangement without any separators, can be used with a set of indicia discs labeled "A"–"Z" to select six letters for spelling or word games.

Figure 8:
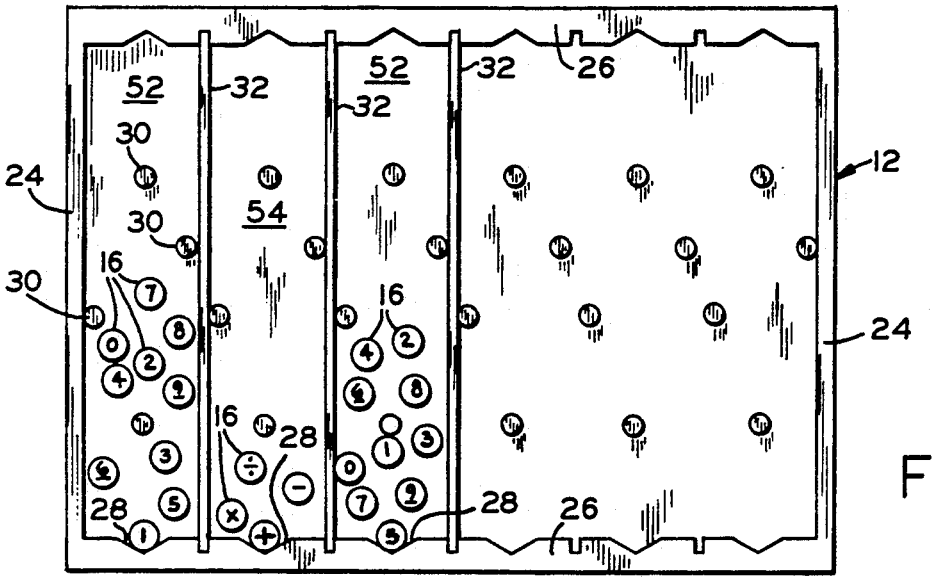
FIG. 8 is a top plan view of the frame of the present invention arranged into three selecting compartments for selecting a math equation.

A math game can be played by using randomizer 10 to generate equations, as shown in FIG. 8. Argument compartments 52 contain ten indicia discs 16 labeled 0–9 for selecting a one digit number as an argument. For purposes of illustration, each argument has only one digit. However, the arguments could have more digits by adding more indicia disks and including more recesses within argument compartments 52. Operand compartment 54 contains indicia discs 16 labeled "+", "−", "×", and "÷" which represent the operations of addition, subtraction, multiplication, and division, respectively. After mixing discs 16, frame 12 is tilted so discs 16 travel downwardly towards a receptacle wall 26 and one of discs 16 rests in recess 28. Thus, the randomizer selects the numeric operands and the mathematical operation.

Figure 9:
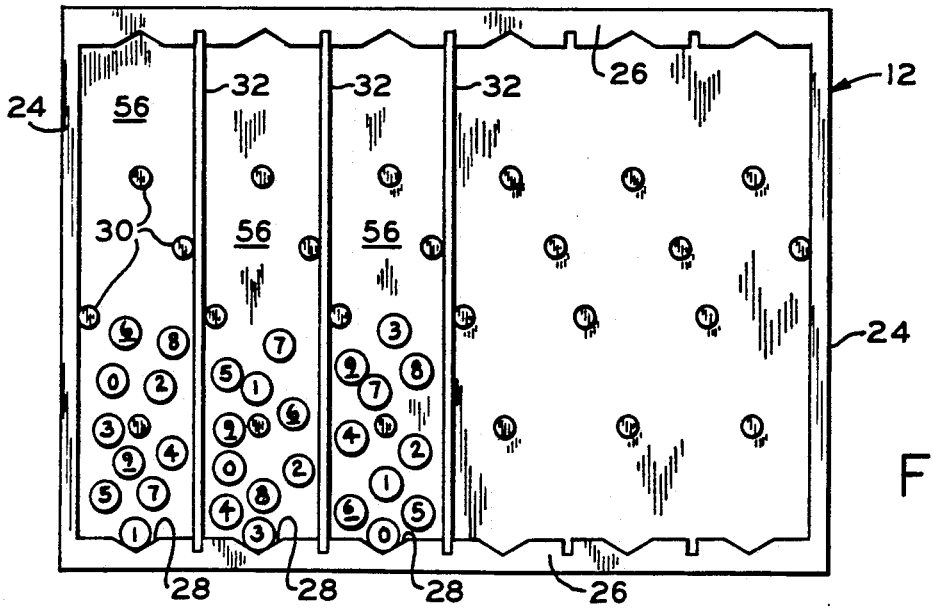
FIG. 9 is a top plan view of the frame of the present invention arranged into three selecting compartments for selecting a three digit number.

The random generation of a three digit number is accomplished by the arrangement of FIG. 9. Three separators 32 are arranged to define three digit selecting compartments 56. In each compartment 56, ten indicia discs labeled 0–9 are mixed so that one disc 16 can rest in one of the recesses 28 which is located at each end of compartment 56. A random number having as little as one digit, or as many as n digits (where n is the maximum number of recesses 28 located on any receptacle wall 26), can be generated by forming the appropriate number of digit selecting compartments, mixing, then selecting the digits by tilting randomizer 10 in the appropriate direction.

Other games can also be played with randomizer 10. For example, dice can be played by forming digit selecting compartments but only using indicia balls labeled 1–6. Also, a single color can be selected from a set of colored discs by using the compartment arrangement of FIG. 4, or many colors can be selected by using the compartment arrangement of FIG. 1 or 7 with the colored discs.

In the exemplary embodiment of the present invention, frame 12 has a length of approximately 11" and a width of approximately 8". The height of the side and receptacle walls 24 and 26 is approximately ¾".

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for selecting a subset of indicia from a set including a plurality of indicia elements, said apparatus comprising:

a frame including a base and a plurality of walls;

a cover positioned on said frame, an interior region being defined by said cover, said base, and said walls, said interior region positioned between said frame and said cover;

a plurality of receptacles in communication with said interior region, each said receptacle adapted to select one of the indicia elements; and at least one separator means for subdividing said interior region into a plurality of compartments, said separator means detachably positioned within said interior region.

2. The apparatus of claim 1 wherein the indicia elements are disposed in said interior region, said apparatus further including a plurality of deflection means for deflecting the indicia elements when traveling within said interior region.

3. The apparatus of claim 2 wherein said deflection means are positioned on said base and arranged to block the travel of the indicia elements in a straight path between one of said walls and the other of said walls.

4. The apparatus of claim 1 wherein said frame includes a plurality of support slots on said walls for engaging said separator means, said support slots located so that said separators are positioned intermediate adjacent receptacle means.

5. The apparatus of claim 4 wherein said separator means are detachably engaged with said support slots.

6. The apparatus of claim 5 wherein said frame is substantially rectangular, said separator means are positioned by said support slots and extend substantially from said base to said cover, and said support slots are arranged in pairs so that each pair of support slots define a line substantially perpendicular to said walls.

7. The apparatus of claim 6 wherein said separator means comprise an elongate body substantially rectangular in cross-sectional shape.

8. The apparatus of claim 1 wherein at least one of said separator means includes a bent section so that two adjacent separator means define a compartment having a cross-sectional area greater than the cross-sectional area of a quadrilateral region bounded by adjacent separator means and said walls.

9. The apparatus of claim 1 wherein said cover is removably attached to said frame.

10. The apparatus of claim 9 wherein said cover includes a top surface and at least two flanges extending from edges of said top surface, said flanges having an inwardly extending edge for holding said frame.

11. The apparatus of claim 10 wherein said cover is adapted to slide on and off said frame, said cover further including an end stop for limiting the sliding of said cover.

12. The apparatus of claim 10 wherein at least one of said base and said top surface are transparent so that the indicia elements are externally visible.

13. The apparatus of claim 1 wherein at least one of said receptacles includes a recess defined by one of said walls.

14. A randomizing apparatus comprising:

a frame including a base and a plurality of walls;

a cover positioned on said frame, an interior region being defined by said cover, said base, and said walls, said interior region positioned between said frame and said cover;

a plurality of indicia elements disposed within said interior region, each said indicia element for indicating a member of a predetermined set of symbols;

a plurality of receptacles in communication with said interior region, each said receptacle adapted to select one of said indicia elements; and at least one separator means for subdividing said interior region into a plurality of compartments, said separator means detachably positioned within said interior region.

15. The randomizing apparatus of claim 14 wherein each said indicia element comprises a disc having a cylindrical shape and a face with a label indicative of a member of said predetermined set of symbols.

16. The randomizing apparatus of claim 14 wherein said indicia elements include a portion representing a first predetermined set of symbols comprising the numbers n to m, and said separator means is arranged so that p receptacle means are located in one of said compartments with said indicia elements thereby providing for the random selection, without replacement, of p numbers from the range of n to m.

17. The randomizing apparatus of claim 14 wherein said indicia elements includes a portion representing a first predetermined set of symbols comprising mathematical symbols, said indicia elements also including a portion representing a plurality of second predetermined sets of symbols comprising the numbers 0 to 9, said separator means being arranged to provide at least three compartments, each of said compartments in communication with at least one receptacle, a first compartment including said portion of said indicia elements representing said first predetermined set, a second and third compartment including said portions of said indicia elements representing said second predetermined set whereby an equation is generated having an operand selected by said first compartment, a first argument selected by said second compartment, and a second argument selected by said third compartment.

18. The randomizing apparatus of claim 14 wherein said indicia elements includes n predetermined sets comprising the numbers 0 to 9, said separator means arranged to form n compartments, each said compartment in communication with at most one receptacle, each of said n predetermined sets of said indicia elements located in one of said n compartments whereby an n digit number is selected.

19. An apparatus for selecting a subset of indicia elements from a set including a plurality of indicia elements, said apparatus comprising:

a frame including a base and a plurality of walls defining an interior region;

a plurality of receptacles in communication with said interior region, each said receptacle adapted to select one of the indicia elements; and at least one separator means for subdividing said interior region into a plurality of compartments, said separator means detachably positioned within said interior region.

* * * * *